US010359259B2

(12) United States Patent
Zimmerman

(10) Patent No.: US 10,359,259 B2
(45) Date of Patent: Jul. 23, 2019

(54) GUN FRAME AND GUN WITH ADDITIONAL FEATURES

(71) Applicant: Kevin Zimmerman, Lancaster, PA (US)

(72) Inventor: Kevin Zimmerman, Lancaster, PA (US)

( * ) Notice: Subject to any disclaimer, the term of this patent is extended or adjusted under 35 U.S.C. 154(b) by 196 days.

(21) Appl. No.: 15/294,199

(22) Filed: Oct. 14, 2016

(65) Prior Publication Data

US 2017/0108310 A1 Apr. 20, 2017

Related U.S. Application Data

(60) Provisional application No. 62/241,789, filed on Oct. 15, 2015.

(51) Int. Cl.

| | |
|---|---|
| ***F41H 9/10*** | (2006.01) |
| ***F41C 23/22*** | (2006.01) |
| ***F41A 19/10*** | (2006.01) |
| ***F41A 19/18*** | (2006.01) |
| ***F41A 19/11*** | (2006.01) |
| ***F41H 13/00*** | (2006.01) |
| ***F41A 3/66*** | (2006.01) |
| ***F41C 3/00*** | (2006.01) |

(52) U.S. Cl.

CPC ..... *F41H 9/10* (2013.01); *F41A 3/66* (2013.01); *F41A 19/10* (2013.01); *F41A 19/11* (2013.01); *F41A 19/18* (2013.01); *F41C 3/00* (2013.01); *F41C 23/22* (2013.01); *F41H 13/0012* (2013.01)

(58) Field of Classification Search

CPC ..... F41C 27/00; F41C 23/00; F41A 35/00
See application file for complete search history.

(56) References Cited

U.S. PATENT DOCUMENTS

| | | | | |
|---|---|---|---|---|
| 5,435,091 | A | 7/1995 | Toole | |
| 5,557,872 | A * | 9/1996 | Langner | F41C 23/22 362/114 |
| 5,673,819 | A | 10/1997 | Brunswig | |
| 8,365,456 | B1 * | 2/2013 | Shepard, Jr. | F41C 23/22 362/110 |
| 8,661,723 | B2 | 3/2014 | Emde | |
| 9,453,702 | B2 * | 9/2016 | Bruhns | F41C 23/10 |
| 2007/0086190 | A1 | 4/2007 | Kukuk | |
| 2016/0172876 | A1 * | 6/2016 | Stewart | F41A 35/00 320/114 |
| 2017/0205191 | A1 * | 7/2017 | Sheets, Jr. | F41C 23/10 |

FOREIGN PATENT DOCUMENTS

WO WO2013132291 A1 9/2013

* cited by examiner

*Primary Examiner* — J. Woodrow Eldred
(74) *Attorney, Agent, or Firm* — Steve O'Donnell

(57) ABSTRACT

A gun frame comprising one or more regions to which a non-lethal (e.g., a flashlight or laser sight) or less-lethal component (e.g., tear gas, pepper spray, or an electrical weapon) may be attached is disclosed. The gun frame may also support a dual-trigger system. A gun comprising the disclosed gun frame with the dual triggering system comprises one trigger which fires a traditional gun's payload, and a second trigger which causes a non-lethal or less-lethal component to fire, while blocking the accidental firing of the traditional payload. Most embodiments of the gun comprising the disclosed frame also have a rechargeable battery, preferably mounted on the gun's magazine, which powers those components requiring electricity.

1 Claim, 8 Drawing Sheets

GUN FRAME AND GUN WITH ADDITIONAL FEATURES

FIELD OF THE INVENTION

The subject matter of this application relates to guns having lethal and non-lethal components. More particularly, it relates to gun and gun frames having non-lethal components and means for firing or turning on these components. Even more particularly, it relates to guns and gun frames having battery powered non-lethal components, a rechargeable battery comprising part of the gun's magazine, and a means for firing or turning on these components while inhibiting accidental firing of the lethal component.

BACKGROUND

Law enforcement agents typically carry a variety of tools on their gun belt. Common tools include a handgun, a radio, mace or pepper spray, an electrical weapon such as a taser, a flashlight, handcuffs and keys, additional magazines, a baton, gloves, a multi-tool, and a small first aid kit. The weight of such equipment may reach as much as 10 kilograms and can lead to, or exacerbate, an array of physical conditions like back pain, knee pain, ankle and foot pain, and can contribute to cartilage and tendon injuries. In addition to problems associated with weight of the belt, the necessary size of it can be unwieldy and interfere with normal movement.

Certainly, although some of the equipment carried on a gun belt may be less important or at least less used than other equipment, a weapon is the one article that can't be omitted. Law enforcement officers are too often in a position which requires them to draw a weapon, however it may rarely be evident if any given situation calls for a non-lethal solution such as tear gas, pepper spray, or an electrical weapon, or if the situation requires lethal force. This uncertainly requires the wise law enforcement officer to make the safest choice and choose to draw the weapon with the most stopping power. After all, it is better to be prepared for the worst and not need it, than to be prepared for something less dangerous than the situation demands. Tragically, this forced decision sometimes results in lethal force being used when non-lethal force would have sufficed, leaving behind an unnecessarily injured or killed person, a law enforcement agent forced to live with the results of this forced decision, a maligned law enforcement agency, and an angered public.

SUMMARY

The subject matter of this application pertains to multi use devices. More particularly, it pertains to firearms comprising one or more non-lethal or less-lethal tools or weapons. Even more particularly it pertains to firearms comprising one or more battery-powered non-lethal or less-lethal tools or weapons and also comprising an easily replaced and rechargeable battery pack. Further, the subject matter of this application pertains to trigger designs which allow the firing of a less-lethal weapon while preventing the accidental discharge of a bullet. The subject matter of this application also pertains to methods for providing power from a rechargeable battery pack located on the firearm to devices capable of being reversibly attached to the firearm.

One preferred embodiment of the subject matter of this application is a gun frame comprising at least two ports capable of receiving non-lethal or less-lethal components such as inter alia, flashlights, laser dot sights, pepper spray or a conductive electrical weapon. The ports may be powered. The gun's magazine comprises a rechargeable battery capable of providing power to the gun's electrical components via an electrical conduit located either within the gun frame itself or on the surface of the gun frame. Another preferred embodiment of the gun frame comprises one or more auxiliary electrical connection points which may be reversibly connected to other electrical devices and powered by the rechargeable battery. Some embodiments further comprise a connection point by which non-powered devices, or those equipped with their own battery, may be reversibly attached to the gun frame. Further a most highly preferred embodiment of the gun frame further comprises a dual triggering system in which one trigger operates a the gun's less or non-lethal component while inhibiting the simultaneous operation of the legal component trigger.

DETAILED DESCRIPTION OF THE DRAWINGS

Figure 1:
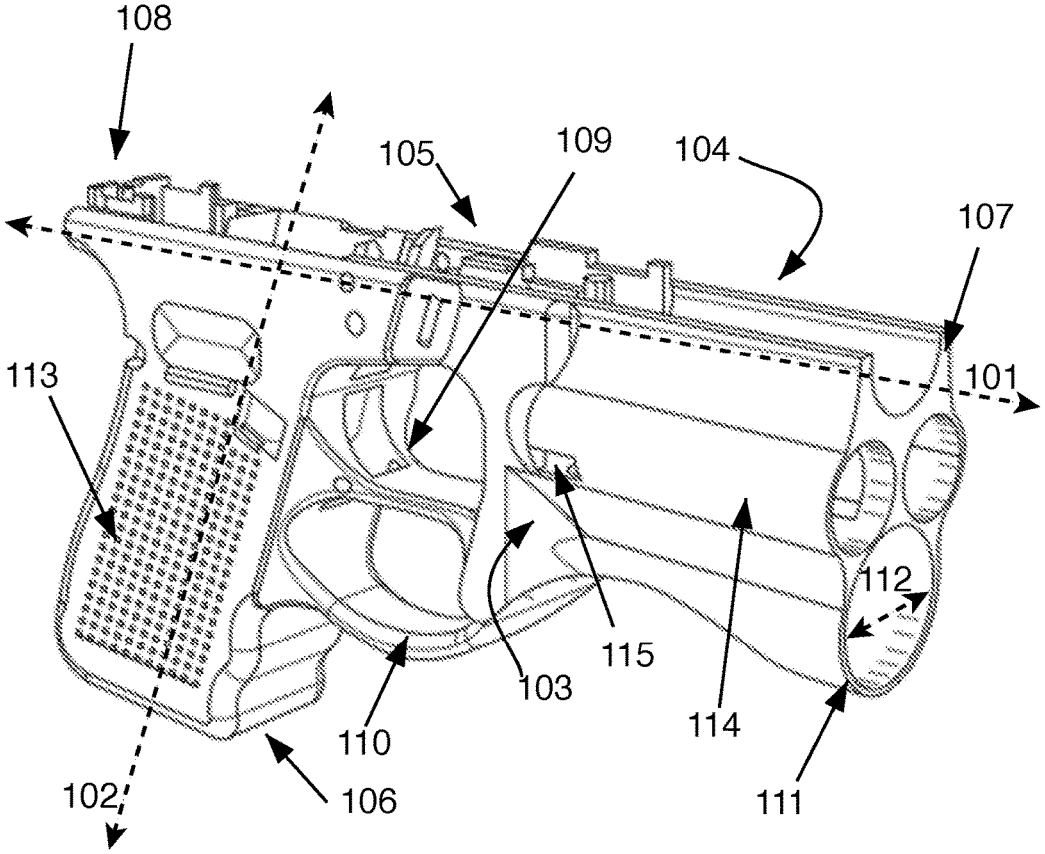
FIG. 1 illustrates a gun frame with two trigger guards and three ports.
Figure 2:
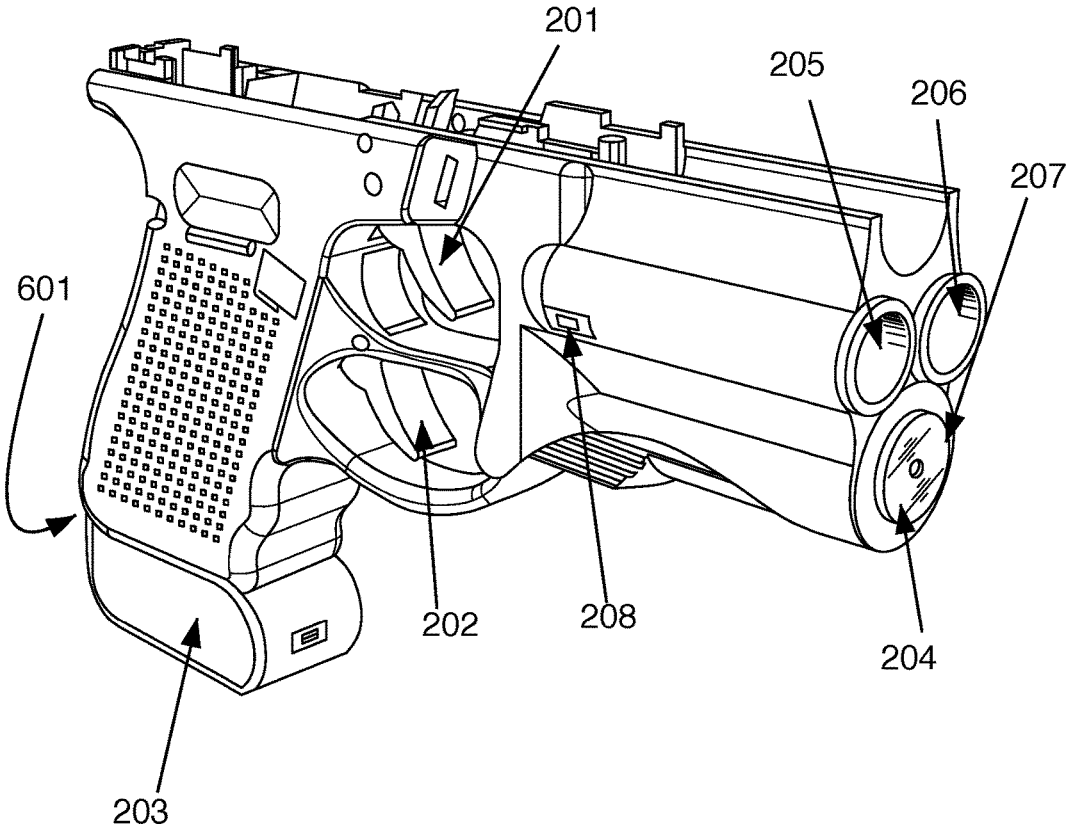
FIG. 2 illustrates the gun frame of FIG. 1 with components installed in the ports and, further showing the gun's magazine, and a primary and secondary trigger.
Figure 3:
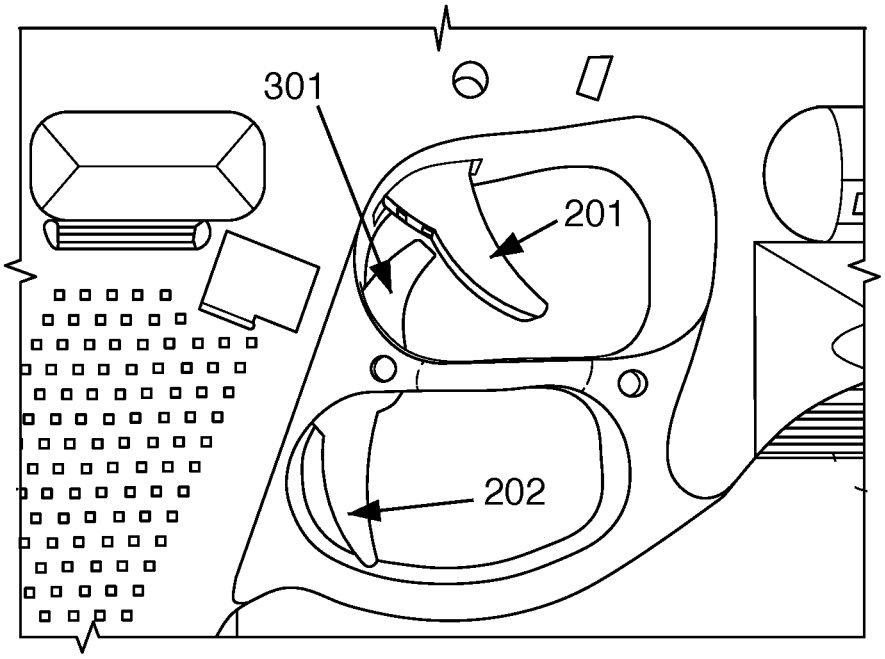
FIG. 3 is a view of the primary and secondary triggers illustrating one way in which squeezing the secondary trigger prevents the simultaneous firing of the primary trigger.
Figure 4:
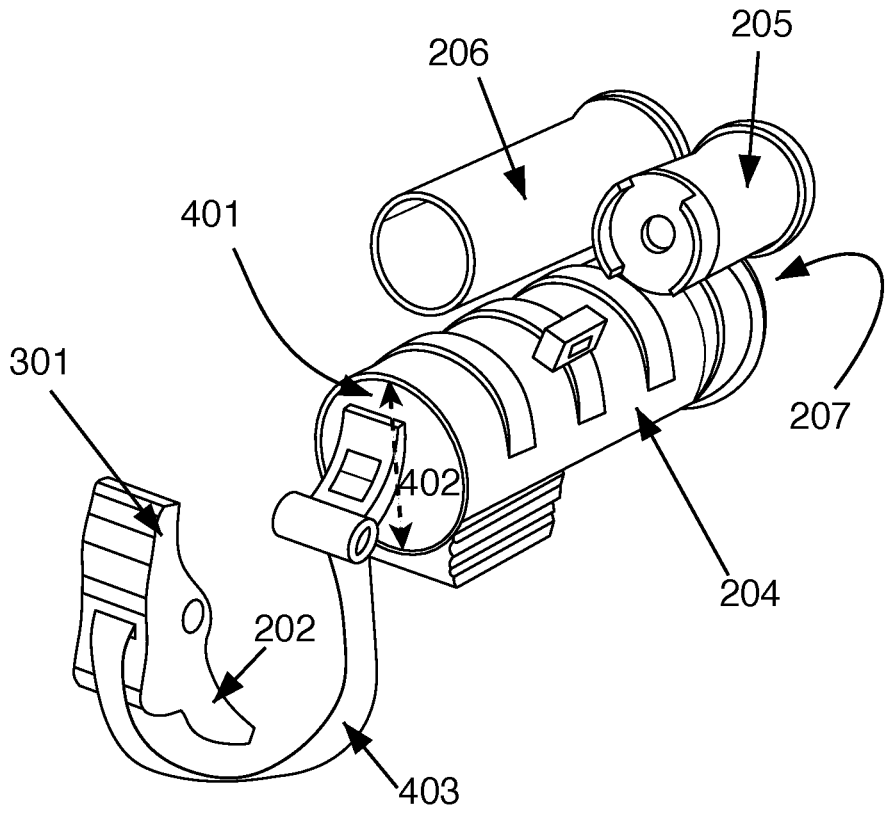
FIG. 4 illustrates the secondary trigger mechanism and the ports' components isolated from the gun frame.
Figure 5:
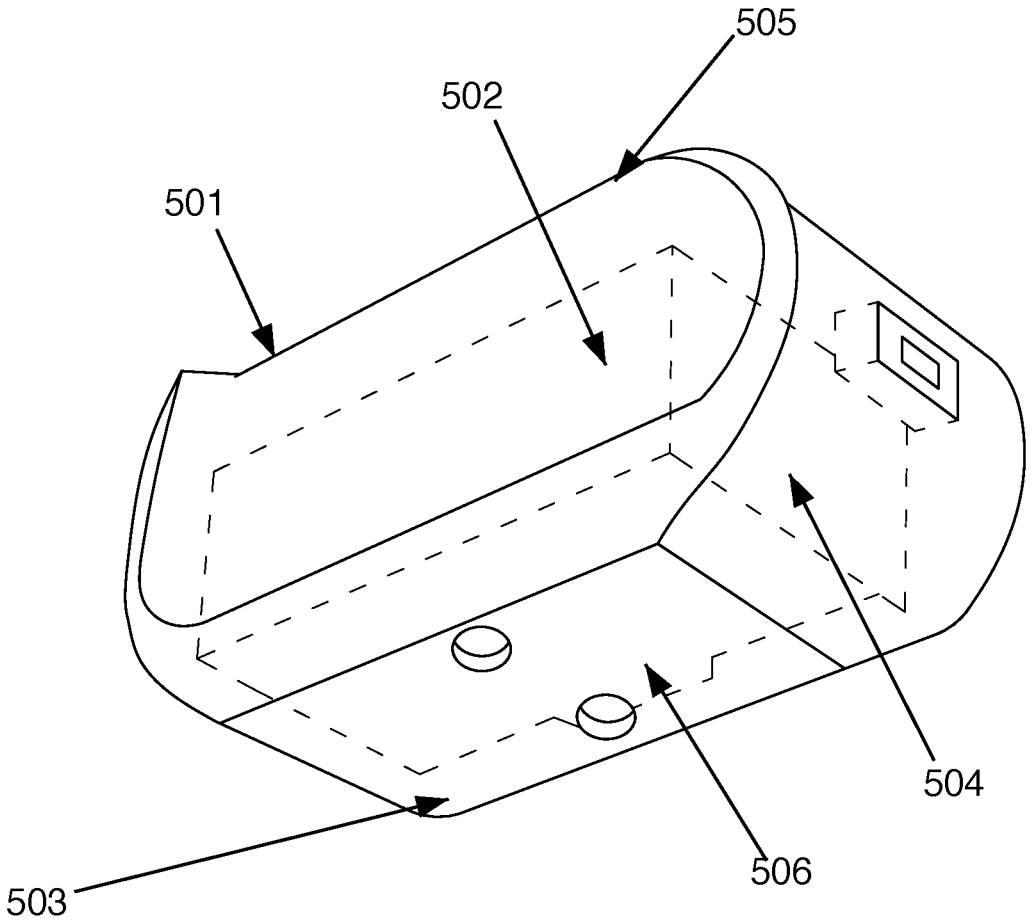
FIG. 5 is a view of a rechargeable battery pack.
Figure 6:
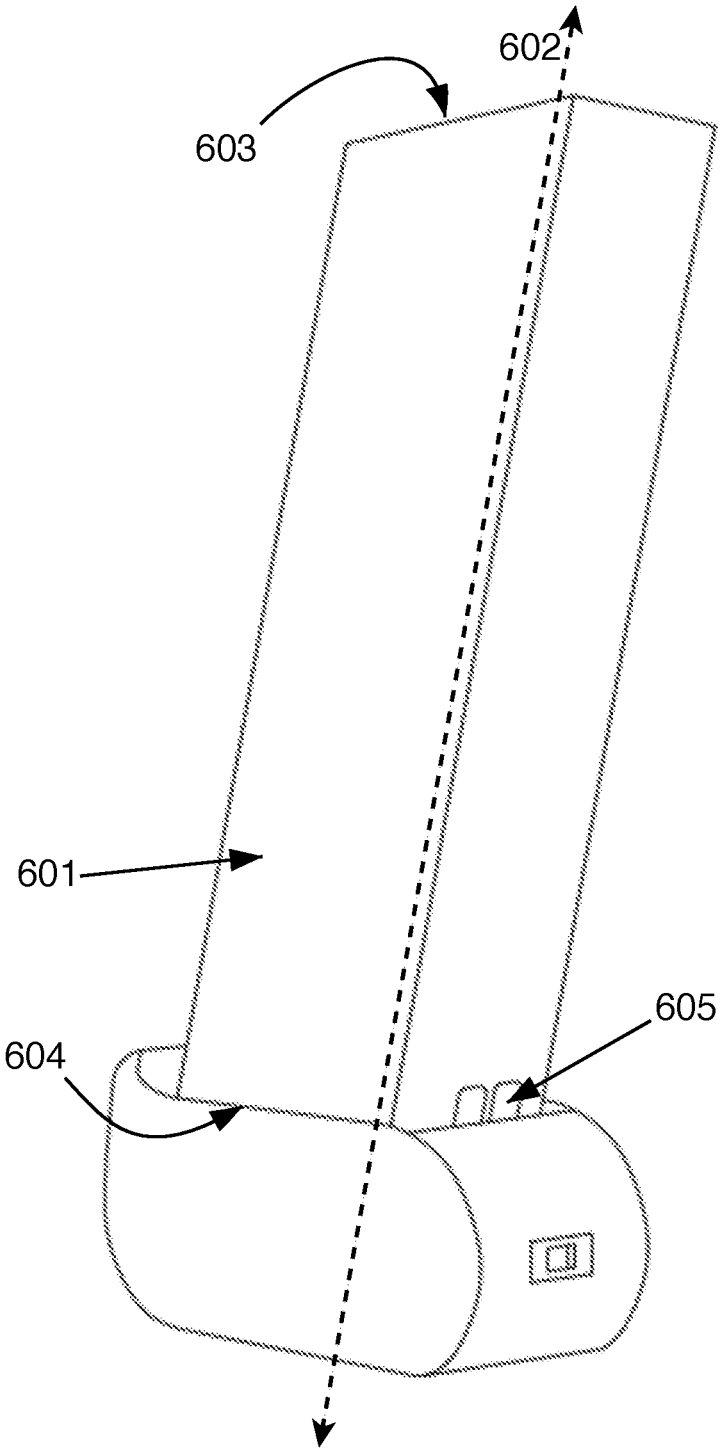
FIG. 6 is a view of a rechargeable battery pack as mounted on a magazine.

The following description and drawings referenced therein illustrate embodiments of the application's subject matter. They are not intended to limit the scope. Those familiar with the art will recognize that other embodiments of the disclosed method are possible. All such alternative embodiments should be considered within the scope of the application's claims.

The first digit of each reference number indicates the drawing where the referenced feature either is first called out or where it is best shown. Reference numbers are not necessarily discussed in the order of their appearance in the figures.

As used herein, non-lethal components are those not typically considered a physical threat such as e.g., flashlights and laser sights. Less-lethal components are those which have a risk of lethality, although the component is designed to minimize such risk such as e.g., tear gas, pepper spray, and electrical weapons (tasers, stun guns, etc.). An "auxiliary device" may be either a non-lethal component or a less-lethal component. Also, a gun frame is the body of a gun to which one would attach a barrel, magazine, trigger, hammer, etc, required to form a working gun. A gun frame may also be referred to a "receiver."

The illustrations and specification discuss the subject matter of this application in context of a handgun, although it should be readily apparent that the teachings of this application may be applied to other firearms and even to non-firearm multi-purpose defensive tools with minimal modification well within the purview of one in the relevant arts.

The subject matter of this application discloses a gun frame comprising at least one non-lethal, or less-lethal, component, and a gun comprising this gun frame. An advantage to this design over other designs in the art is that lessens the number of devices a law enforcement agent would otherwise need to carry in their gun belt, freeing that room to hold other tools if needed. Further, since the components share certain common housing and electrical characteristics, the overall weight of the fully laden gun belt may be reduced. The biggest advantage however, is that the subject matter of this application brings the most commonly used law enforcement tools together so that an officer need not be forced to make a quick decision about whether to draw a gun or to draw a less-lethal weapon. Both such weapons are located together and may be operated separately as the situation requires. One goal is that the multi-use gun frame disclosed will reduce the use of deadly force when less-lethal force would suffice. Further, the location of non-lethal components such as a flashlight or laser on the gun frame itself, eliminate the need to either remove such a tool from the gun belt and hold in in conjunction with holding a firearm.

Further, preferred embodiments of the gun frame support a dual triggering system. As disclosed, one trigger operates the lethal weapon and the other trigger operates the less-lethal weapon. To prevent the accidental simultaneous firing of the lethal and less-lethal weapons, the triggering system comprises a feature which blocks the gun's trigger from being pulled while the less-lethal trigger is pulled.

Other attempts to mount electrical devices on guns require the periodic removal and replacement of disposable or rechargeable batteries. This may result in significantly depleted batteries being carried and dying during use. An advantage of the subject matter of this application is that the battery pack may be placed into a charger when the magazine is removed from the gun. Further, additional battery packs may be connected to additional magazines carried on one's gun belt such that the action of replacing the magazine also replaces the battery powering the gun's electrical components. The battery housing may be distinct and separable from the magazine or the magazine and battery housing may be a single piece.

An embodiment of the disclosed gun frame comprises a longitudinal axis (101), a transverse axis (102), a first face (103), a second face (104), a top (105), a bottom (106), a front (107), a back (108), a primary trigger guard (109), a secondary trigger guard (110), at least one attachment region (e.g., 111) which can accept an auxiliary device, a grip (113) which can accept a magazine, an outer surface (114), and at least one switch (115).

In some preferred embodiments, the attachment region has an internal diameter (112) into which one would insert an auxiliary device. In most preferred embodiments, the attachment region is machined or formed as part of the gun frame; while in other embodiments the attachment region may be reversibly attached to the gun frame. In most preferred embodiments, the auxiliary device may be reversibly attached to the attachment region, although in some embodiments the auxiliary device is permanently attached to the attachment region.

The gun comprises the said gun frame, and further comprises a primary trigger (201), a secondary trigger (202), a magazine (601), and battery pack (203). The magazine comprises a longitudinal axis (602), a top (603) and a bottom (604). The gun frame may further comprise a auxiliary device (204, 205, 206) held reversibly or permanently secured to an attachment region (111). The auxiliary device comprises a front (e.g. 207), a back (401), and an external diameter (402) less than the internal diameter of at least one of the ports (e.g., 111).

The primary trigger (201) operates the lethal component of the gun, i.e. causes a bullet to fire. In response to the user pulling it back, the secondary trigger (202), causes said less-lethal or non-lethal component (204) to fire. In preferred embodiments, the secondary trigger is connected to the less-lethal or non-lethal component's firing mechanism through a triggering linkage (403). In preferred embodiments, the second trigger comprises a mechanism for inhibiting the simultaneous and accidental firing of the primary trigger. In one such preferred embodiment this mechanism is an extension (301) of the secondary trigger which pivots towards the primary trigger thereby preventing the primary trigger from also being pulled by the user.

Figure 7:
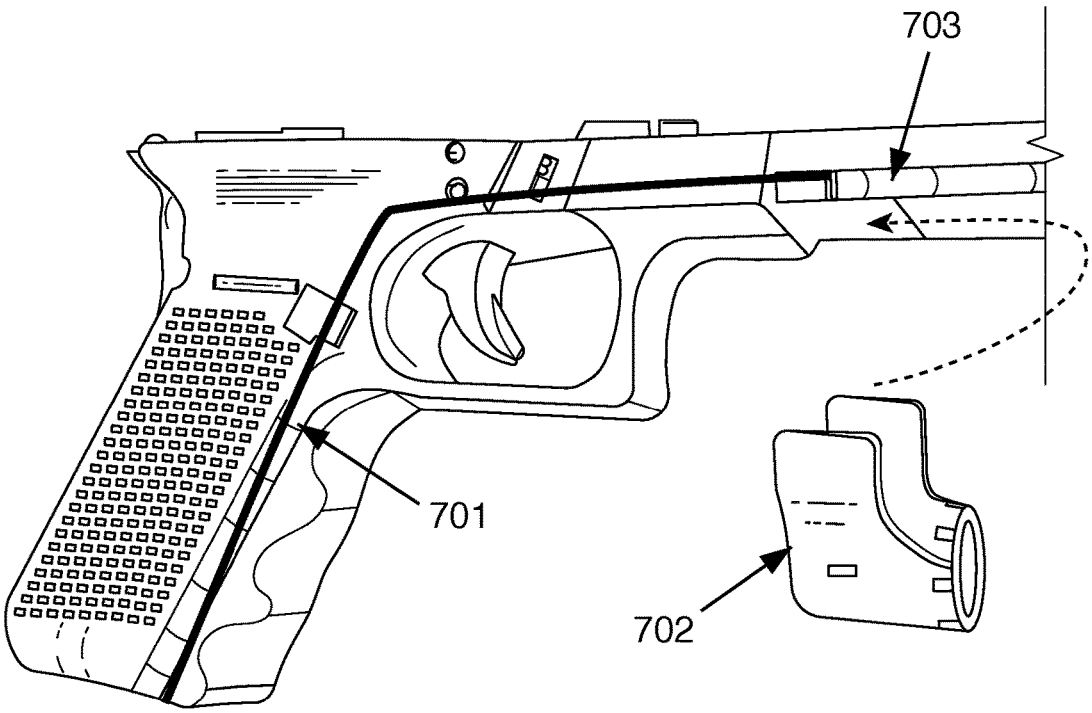
FIG. 7 is a view of an embodiment of the subject matter of this application in which components may be reversibly attached to the gun frame
Figure 8:
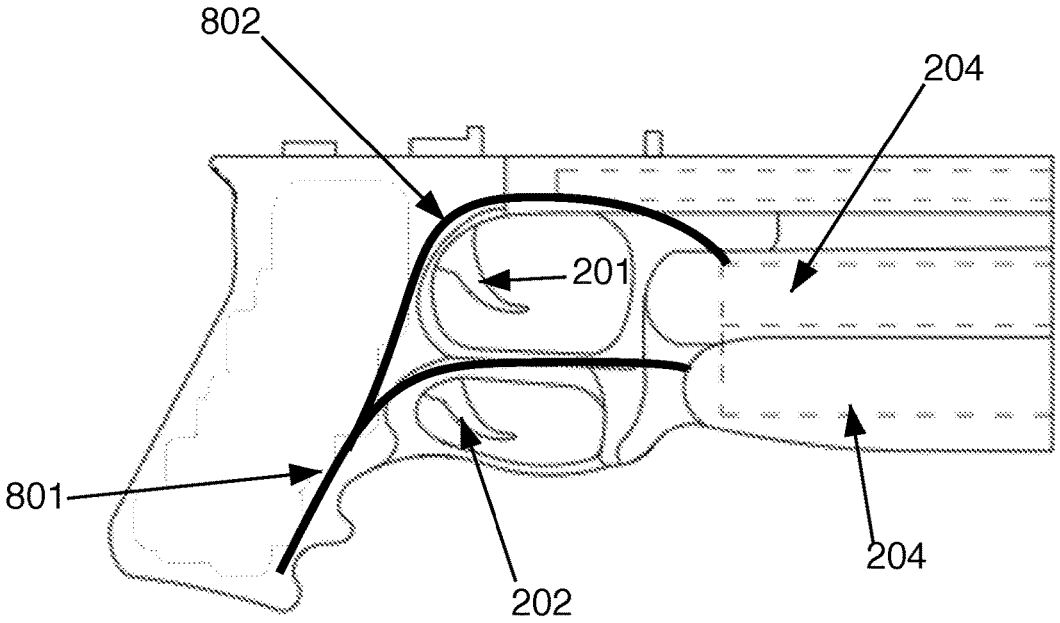
FIG. 8 is a view of an embodiment of the of the subject matter of this application in which the outer surface of the gun frame is removed to show certain internal structures.

A battery pack (203) comprises a housing (501) a battery (502), and at least one electrical conductive point (605). In most preferred embodiments the housing has an external surface (503) and an internal space (504). and the battery is stored within the internal space. The housing may comprise an access point by which a user may access, remove, and replace the battery. The battery pack further comprises a top (505) and a bottom (506). In most preferred embodiments, the top of the battery pack connects to the bottom of the magazine (604) and the electrical conductive point contacts a conducive point inside the grip of the gun housing when the magazine is inserted into the grip. In these embodiments, an electrical conduit (801) running under the surface of the gun frame (114) connects the conductive point of the grip of the gun to the secondary trigger and to the powered component such that when a user pulls the secondary trigger, the circuit is closed and the powered component received power from the battery. A conduit (802) may also form a circuit connecting the conductive point of the grip of the gun to a switch (208) and a powered component (e.g., 205, 206) such that when a user operates the switch the circuit changes state between opened and closed. In an alternate embodiment the conductive points of the battery pack contacts conductive points on the surface of the grip and the conduit (701) runs along the surface of the gun frame connecting the conducive point of the grip to the secondary trigger and to a powered auxiliary device (702) which may be machined or formed as part of the gun frame or, as shown in FIG. 7, may be separate from the gun frame and attached to the gun frame via a connection means (703) the user may attach to typical mass-produced gun or gun frame.

The gun frame and corresponding gun most preferably comprises at least one non-lethal component, powered by the magazine-mounted battery, and operated by a switch; and a less-lethal component operated by a secondary trigger, which may or may not be powered by the magazine-mounted battery. However, alternative embodiments which comprise only non-lethal or less-lethal components, with or without a corresponding lethal component, are within the scope of this disclosure.

To use the most highly preferred embodiment, a user would insert the magazine, which is connected to the battery pack, into the grip of the gun frame, bringing the conductive point of the battery pack in contact with the conductive point of the grip. The conductive points of the grip are connected to an electrical conduit. The conduit forms an circuit comprising the battery, a switch, and a powered auxiliary device. In preferred embodiments the switch is mounted on or near the powered auxiliary device. Operating the switch opens or closes the circuit as desired. Pulling the second trigger causes the less-lethal auxiliary device to fire. The secondary trigger may be connected to the less-lethal device through a physical linkage which transmits work done on the trigger to the less-lethal auxiliary device, or the secondary trigger may be a switch inline with a circuit formed by a conduit connecting the conductive points of the grip and conductive points on the less-lethal auxiliary device. The battery is rechargeable and a user may carry several batteries at any time. In those embodiments where the battery housing it permanently connected to the magazine, replacing the battery is as easy as changing the magazine. In the most highly preferred embodiments, the gun frame comprises one or more attachment regions which may be connected to an auxiliary device. In other embodiments a user may attach connection points to an existing gun and use them in conduction with powered auxiliary devices and the disclosed rechargeable battery system.

I claim:

1. A gun frame comprising an outer surface, a grip, an attachment region, and a conduit, said grip having an internal space and an internal surface, the internal surface comprising a conductive point, said attachment region comprises a first conductive point, a second conductive point, and one component of a two component fastening system, said conduit capable of conducting electricity and of connecting the conductive point on the internal surface of the grip to the first conductive point of the attachment region, said gun frame further comprising a longitudinal axis, a top, a bottom, a front, a back, a primary trigger guard, and a secondary trigger guard, said primary trigger guard comprises a top and a bottom, and is located to the front of the grip, said secondary trigger guard is located under the bottom of the primary trigger guard.

* * * * *